United States Patent [19]

Tabler

[11] Patent Number: 4,544,089

[45] Date of Patent: Oct. 1, 1985

[54] ADJUSTABLE HOLSTER

[76] Inventor: William R. Tabler, 2554 Lincoln Blvd., No. 555, Marina Del Rey, Calif. 90291

[21] Appl. No.: 619,279

[22] Filed: Jun. 11, 1984

Related U.S. Application Data

[63] Continuation of Ser. No. 441,748, Jan. 20, 1983, abandoned.

[51] Int. Cl.[4] ..... F41C 33/02

[52] U.S. Cl. ..... 224/192; 224/253; 224/911

[58] Field of Search ..... 224/911, 912, 192, 198, 224/240, 250, 901, 251, 253; 206/524.3, 317, 205; 24/3 F, 3 R, 2.5, 306

[56] References Cited

U.S. PATENT DOCUMENTS

| | | | |
|---|---|---|---|
| 1,547,800 | 7/1925 | Franz | 224/253 X |
| 2,186,191 | 1/1940 | Beckwith . | |
| 2,434,380 | 1/1948 | Williams | 224/911 X |
| 3,227,336 | 1/1966 | Dickey . | |
| 3,583,611 | 6/1971 | Theodore . | |
| 3,630,420 | 12/1971 | Bianchi | 224/911 X |
| 3,731,858 | 5/1973 | Baker | 224/911 X |
| 3,894,667 | 7/1975 | Baldocchi . | |
| 4,022,361 | 5/1977 | Devlin . | |
| 4,044,929 | 8/1977 | Caruso | 224/224 |
| 4,044,930 | 8/1977 | Petroski . | |
| 4,190,183 | 2/1980 | Yates . | |
| 4,257,464 | 3/1981 | Binney | 224/911 X |
| 4,258,871 | 3/1981 | McMahon | 224/911 X |
| 4,463,847 | 8/1984 | Gordon | 224/911 X |

FOREIGN PATENT DOCUMENTS

| | | | |
|---|---|---|---|
| 1012108 | 6/1977 | Canada | 224/911 |
| 2527351 | 2/1976 | Fed. Rep. of Germany | 224/911 |

OTHER PUBLICATIONS

Pistol & Revolver Digest, Grennell, Dean A., Ch. 18, p. 216ff, "Holsters and Other Accessories", ©1976, Follet Publ. Co., Chicago, Ill.

*Primary Examiner*—Stephen Marcus
*Assistant Examiner*—Robert Petrik
*Attorney, Agent, or Firm*—Fulwider, Patton, Rieber, Lee & Utecht

[57] ABSTRACT

A handgun holster includes a strap which is adjustably positionable on a wearer's belt, and a bluing protection pad having one end adjustably secured to the strap and the other end to the belt. In use, the bluing protection pad is folded between the belt and the strap to define an adjustable gun receiving pocket capable of securing a wide variety of handguns. The interior of the gun receiving pocket is lined to protect and preserve the gun's blued finish, and such protection is enhanced by the treatment of the liner with a light film of oil.

17 Claims, 10 Drawing Figures

ADJUSTABLE HOLSTER

RELATED APPLICATION

This application is a continuation of Ser. No. 06/441,748, filed Jan. 20, 1983, now abandoned.

BACKGROUND OF THE INVENTION

This invention relates generally to carriers for handguns and the like, and, more specifically, to an adjustable holster which can securely accommodate a wide variety of handguns while providing superior protection for the same against the corrosive effects of leather.

Typically, holsters are manufactured substantially of leather to form a rigid and non-adjustable gun receiving pouch or pocket. These holsters, which each can only accommodate one size of handgun, are usually worn either on a gun belt designed specifically for holding such holsters, or on some other type of suitable strap. Moreover, the typical holster is manufactured for use by either a right or left handed shooter, but not both.

Prior holsters have generally shared one or more drawbacks making each less than ideal. For example, the tannic acid contained in holster leather has a corrosive effect on a gun's bluing. The gradual erosion of a gun's bluing can reduce the aesthetic beauty of the gun, as well as its resale value. Further, the typical holster, when worn on a belt, usually interferes with one or more of the wearer's pockets. Moreover, prior holsters have been constructed to be non-adjustable, requiring gun enthusiasts to buy several holsters to accommodate several handguns of varying sizes.

Accordingly, there has been a need for an improved holster which can be adjusted to accommodate most all sizes of handguns. Such an adjustable holster must be inexpensive an comfortable to wear. Further, an adjustable holster should protect the handgun's blued finish from damage due to unnecessary contact with abrasives, or contact with tannic acid. To be truly versatile, an improved holster must also be constructed for use by both right and left handed shooters. The present invention fulfills these needs and provides other related advantages.

SUMMARY OF THE INVENTION

The present invention resides in an adjustable holster which can be configured for use by both right and left handed shooters, and for a variety of handgun sizes and types. The adjustable holster includes generally a belt strap positionable on a wearer's belt, and a bluing protection pad having one end adjustably secured to the belt strap and the other end to the belt. The bluing protection pad is folded and securely held between the belt strap and the wearer's belt to create an adjustable, open-ended gun receiving pocket. The interior of the gun receiving pocket is lined to protect and preserve the gun's blued finish by isolating the handgun from holster leather, and more particularly, the tannic acid in the holster leather. Additionally, this liner can be treated with a light film of oil or the like, to further protect the gun's finish.

The adjustable holster of the present invention can be assembled into a plurality of configurations to accommodate either large or small frame handguns. Moreover, the adjustable holster can be quickly and easily adjusted and modified to fit a handgun having a different size from that originally carried, or for the convenience of a shooter preferring to use the hand opposite that used by a previous user. These adjustments can be accomplished by simply changing the manner in which the belt strap is supported on the belt, and the positioning of the bluing protection pad on the belt strap. This dual adjustment feature permits the wearer to customize the adjustable holster to his individual needs and desires.

In a preferred form of the invention, the belt strap is formed of a flat, belt-like leather to be symmetrical through an axis perpendicular to its length. The strap includes a plurality of belt receiving slots through which the wearer's belt is threaded to securely mount the strap onto the belt. On an inner face of the belt strap (the face closest to the wearer when the adjustable holster is worn), a segment of loop tape is provided. This loop tape interacts with a corresponding segment of hook tape provided on the bluing protection pad to securely, yet adjustably, affix that pad to the belt strap.

The bluing protection pad is preferably formed of woolskin which includes a leathery outer surface for strength and durability and a woolly protective inner surface. The pad is generally symmetrical about a longitudinal axis, and the pad includes a single belt receiving slot near one end. Opposite the pad's receiving slot, the section of hook tape is securely affixed to the leathery outer surface in a manner consistent with maintaining the symmetry of the pad about its longitudinal axis. When the bluing protection pad is affixed to the belt strap by pressing the corresponding segments of hook and loop tape together, the gun receiving pocket can be formed by simply folding the pad generally perpendicular to its longitudinal axis. The woolly protective inner surface of the pad provides the pocket inner lining.

Typically, after the belt strap and the pad have been mated, the belt is then passed through one or more strap slots, through the pad receiving slot, and along the folded bluing protection pad so that the pad is sandwiched between the belt and the belt strap. Finally the belt is passed through one or more strap slots provided in the end of the belt strap opposite the first strap slot(s), to securely position the adjustable holster on the belt. The size of the gun receiving pocket can be varied to accommodate a multitude of handguns separately by simply adjusting the attachment between the pad and the belt strap, and by adjusting the attachment of the belt strap to the belt.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
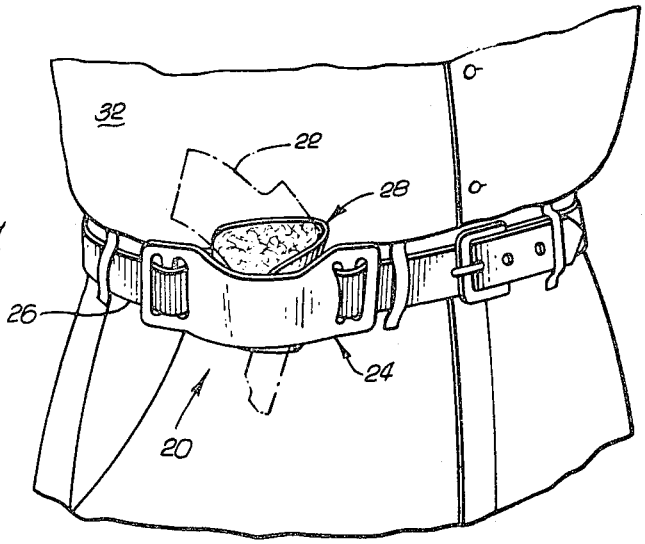
FIG. 1 is a perspective view of an adjustable holster embodying the invention, illustrating the manner in which the holster is typically positioned on a wearer's belt to accommodate a small handgun (shown in phantom)
Figure 2:
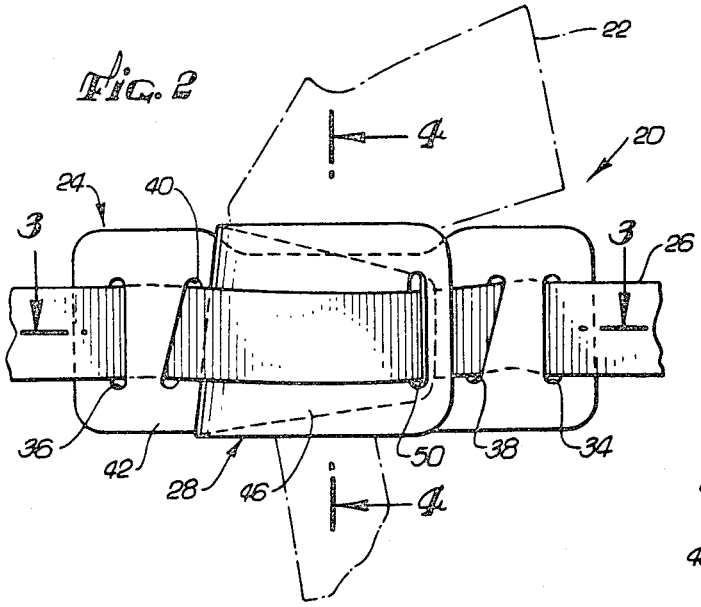
FIG. 2 is an enlarged view of the adjustable holster illustrated in FIG. 1, showing the configuration of that portion of the holster facing the wearer's trousers.
Figure 4:
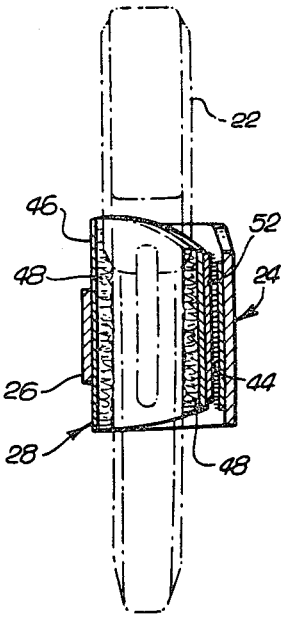
FIG. 4 is a vertical sectional view taken generally along the line 4—4 of FIG. 2.
Figure 3:
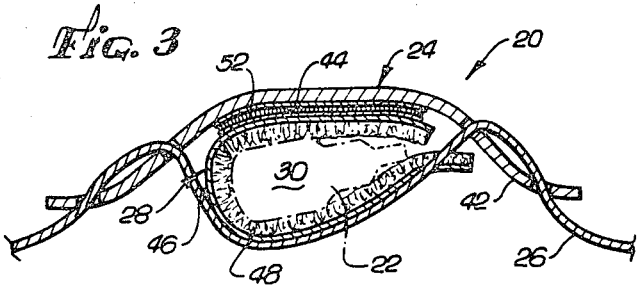
FIG. 3 is a horizontal sectional view taken generally along the line 3—3 of FIG. 2, illustrating the configuration of a gun receiving pocket sandwiched between a belt strap and the wearer's belt.

As shown in the drawings for purposes of illustration, the present invention is concerned with an adjustable holster, generally designated by the reference number 20, which is capable of securing a wide range of different handguns 22 having various sizes and shapes. The adjustable holster 20 includes generally a belt strap 24 which can be positioned in a plurality of ways on a wearer's belt 26, and a bluing protection pad 28. In use, the bluing protection pad 28 is folded and securely held between the belt strap 24 and the wearer's belt 26 to form an adjustable, open-ended gun receiving pocket 30.

The adjustable holster 20 of the present invention protects and preserves the gun's blued finish by isolating the gun's finish from the tannic acid found in holster leather. Furthermore, the bluing protection pad 28 can be treated with a light film of oil to protect the gun's finish and to retard moisture absorbancy in the pad. This protects the value of the handgun 22 since the condition of the bluing has a direct effect on a gun's resale price.

The adjustable holster 20 is sufficiently versatile to be worn on either side of the torso 32 or at the small of a wearer's back, and it can be used by both right and left handed shooters. Moreover, the gun receiving pocket 30 is open-ended to accommodate handguns having different barrel lengths. Unlike other bulkier holsters with a conventional gun receiving pocket, the adjustable holster's open-ended gun receiving pocket 30, together with the holster's relatively small size and narrow width, produces a compact holster which does not hinder access to the trouser pocket beneath the holster. This construction enables a shooter to carry ammunition, a spare magazine, or a sight adjustment tool in his trouser pocket which would otherwise be covered with a conventional holster.

Figure 5:
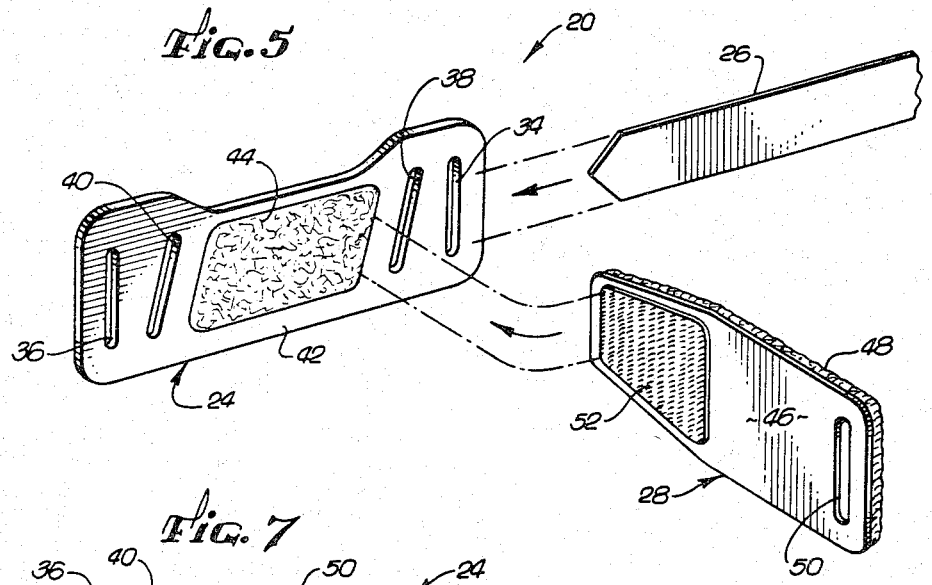
FIG. 5 is an exploded perspective view of the adjustable holster shown in FIGS. 1 through 4, illustrating the relationship between the belt strap, a bluing protection pad, and the belt.

In accordance with the present invention, and as illustrated in FIGS. 1 through 10, the belt strap 24 is preferably die cut on a clicker machine from a single piece of 10 or 11 ounce leather to be symmetrical through an axis perpendicular to its length. The belt strap 24 is generally flat and flexible, and includes a pair of symmetrically located outer belt receiving slots 34 and 36 and a pair of inner belt receiving slots 38 and 40 (FIG. 5). These belt receiving slots 34, 36, 38 and 40 facilitate positioning of the belt strap 24 on the wearer's belt 26, and the manner of such positioning can be varied to adjust the size of the gun receiving pocket 30. Positioned evenly between the innermost belt receiving slots 38 and 40, and on the inside surface 42 (the side facing the wearer) of the belt strap 24, is a segment of loop tape 44 commonly sold under the trademark Velcro. This loop tape 44 is preferably epoxy glued or sewn to the belt strap 24 to maintain its overall symmetrical configuration.

The bluing protection pad 28 is similarly preferably die cut on a clicker machine from a single piece of woolskin which has a leathery outer surface 46 and a woolly protective inner surface 48. The bluing protection pad 28 is designed to be generally symmetrical about its horizontal or longitudinal axis so that it can be reversed and inverted for either right or left handed holster use. One end of the pad 28 includes a belt receiving slot 50 through which the belt 26 is passed to help define and configure the gun receiving pocket 30. Opposite this belt receiving slot 50, the pad tapers slightly.

A segment of hook tape 52, also commonly sold under the trademark Velcro, is securely affixed to the outer surface 46 of the tapered portion in a manner consistent with maintaining the symmetry of the pad 28 about its longitudinal axis. This segment of hook tape 52, which is preferably glued or sewn to the pad 28, is designed to interact with the corresponding segment of loop tape 44 provided on the strap 24 to securely, yet adjustable affix the pad to the belt strap. When the bluing protection pad 28 is affixed to the belt strap 24 by pressing the corresponding segments of hook and loop tape 52 and 44 together, the gun receiving pocket 30 can be formed by simply folding the pad generally perpendicular to its longitudinal axis. The woolly protective inner surface 48 of the pad 28 provides the inner lining for the gun receiving pocket 30.

Figure 6:
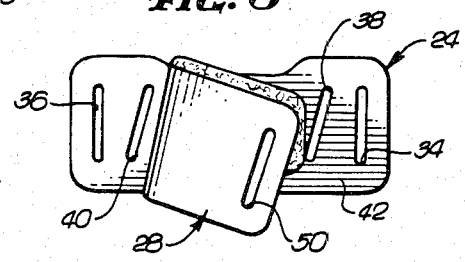
FIG. 6 is an inside view of the adjustable holster, illustrating how the bluing protection pad is attached to the belt strap and folded generally perpendicular to its longitudinal axis to form a gun receiving pocket for a right handed shooter.
Figure 10:
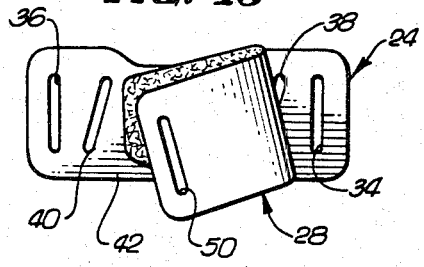
FIG. 10 is an inside view similar to that shown in FIG. 6, illustrating the attachment of the bluing protection pad to the belt strap for a left handed shooter.

As illustrated in FIGS. 6 and 10, the bluing protection pad 28 can be positioned upon the belt strap 24 to accommodate both right and left handed shooters. All that is necessary to change from a right (FIG. 6) to a left handed (FIG. 10) configuration, or vice versa, is to disassociate the pad 28 from the belt strap 24, invert the pad, and then reapply it to the belt strap utilizing the loop and hook tape 44 and 52 for secure connection.

The versatility of the adjustable holster 20 is further enhanced because it provides a user dual adjustments for configuring the gun receiving pocket 30 to snugly hold almost any size and shape of handgun. These adjustments can be effected by changing the number of belt receiving slots 34, 36, 38 and 40 through which the wearer's belt 26 is threaded through the belt strap 24, and/or by adjusting the positioning of the bluing protection pad 28 upon the belt strap. The adjustment of the belt 26 through the strap receiving slots 34, 36, 38 and 40 defines the general size and shape of the gun receiving pocket 30. Adjusting the positioning of the bluing protection pad 28 upon the belt strap 24 permits the user to customize the precise size, shape and angle of the gun receiving pocket 30 to meet his individual needs and desires.

Figure 9:
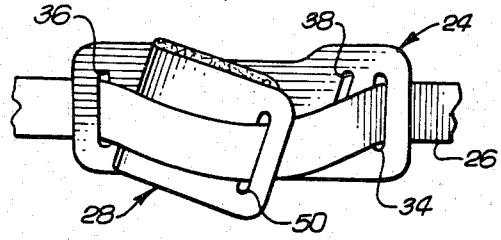
FIG. 9 is a view similar to that shown in FIGS. 7 and 8, illustrating the holster as adjusted to accommodate a large frame handgun.

As best illustrated in FIG. 9, for extra large and large frame handguns, only the two outermost strap receiving slots 34 and 36 would be utilized, in connection with the pad receiving slot 50, to support the adjustable holster 20 on the wearer's belt 26. An exemplary method for placing the adjustable holster 20 on the wearer's belt 26 would be to first pass the belt through one of the outermost strap receiving slots 34 starting from the outside of the belt strap 24 (the side facing away from the wearer), and then passing the belt through the pad receiving slot 50. The belt 26 would be looped over the folded bluing protection pad 28 and then passed through the opposite outermost strap slot 36.

Figure 8:
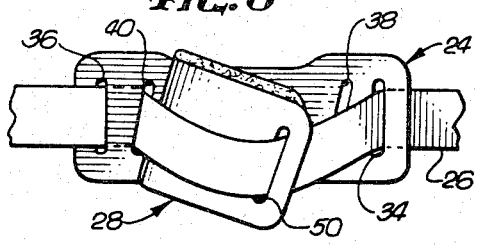
FIG. 8 is a view similar to that shown in FIG. 7, illustrating a typical manner of positioning the holster to accommodate an intermediate frame handgun.

FIG. 8 illustrates an exemplary manner in which the adjustable holster 20 could be placed on the wearer's belt 26 to accommodate an intermediate or medium size handgun. The technique is basically the same as that described above, with the exception that after the belt 26 has been passed through the belt receiving slot 50 on the pad 28, the belt is passed through one of the inner strap slots 40 as well as the final outer strap slot 36. By threading the belt 26 through three of the belt receiving slots 34, 36 and 40 on the belt strap 24, the area available within which to place the handgun 22 is reduced, thereby providing a snug, custom fit for medium framed handguns.

Figure 7:
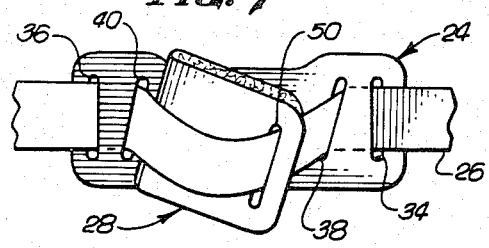
FIG. 7 is an inside view of the adjustable holster embodying the present invention, illustrating a typical manner of positioning of the holster on the belt to accommodate a small frame handgun.

Similarly, FIG. 7 illustrates the manner in which the adjustable holster 20 would be placed on the wearer's belt 26 to accommodate a small handgun. In this case, all four of the strap receiving slots 34, 36, 38 and 40 would be utilized, as well as the belt receiving slot 50 on the bluing protection pad 28. The net effect of utilizing all four strap slots 34, 36, 38 and 40 is to further reduce the area available for positioning the handgun 22, and consequently restrict the positioning and configuration of the folded pad 28 which is securely held between the belt 26 and the belt strap 24.

After the adjustable holster 20 has been positioned on the wearer's belt 26 as required by the size of the handgun 22 to be carried, the bluing protection pad 28 can be repositioned on the belt strap 24 for minor adjustments to facilitate a snug custom fit. Besides isolating the gun's blued finish from the tannic acid found in leather, the woolly protective inner surface 48 of the pad 28 cushions against the abrasive texture of leather. When oil is added to the woolly surface 48, the protection afforded the handgun 22 carried within the adjustable holster 20 is maximized.

As is evident from the foregoing, the ability to adjust the positioning of the belt strap 24 on the belt 36, in conjunction with the ability to adjust the positioning of the bluing protection pad 28 upon the belt strap, allows a user to sufficiently alter the size and shape of the gun receiving pocket 30 to allow the holster 20 to accept and secure a wide variety of handguns having many differently sized frames and designs (i.e., body autoloaders and revolvers). The holster of the present invention is especially useful in situations where no conventional commercial holster is available. Further, the adjustable holster is inexpensive to manufacture, sturdy, and can be used successfully as a universal handgun holster for most all types of handguns and most all shooters.

Although a particular embodiment of the invention has been described in detail for purposes of illustration, various modifications may be made without departing from the spirit and scope of the invention. Accordingly, the invention is not to be limited, except as by the appended claims.

I claim:

1. A holster positionable on a belt for holding a handgun, said holster comprising:

a bluing protection pad having a leathery outer surface and a woolly protective inner surface;

means for holding said pad in a position generally folded perpendicular to its longitudinal axis to create a gun receiving pocket lined by said protective inner surface;

means for supporting said bluing protection pad generally adjacent the belt, said supporting means adjustable with respect to the belt to permit a wearer to change the size, orientation and location of said gun receiving pocket; and means for removably attaching said bluing protection pad to said supporting means, said attaching means permitting the adjustment of said gun receiving pocket to provide a custom fit for a multitude of handgun sizes and shapes.

2. A holster according to claim 1, wherein said holding means securely positions said pad substantially between the belt and said supporting means.

3. A holster according to claim 2, wherein said bluing protection pad includes a belt receiving slot near one end thereof.

4. A holster according to claim 1, wherein said protective surface is impregnanted with a light film of oil.

5. A holster according to claim 1, wherein said gun receiving pocket is open-ended.

6. A holster according to claim 1, wherein said supporting means and said bluing protection pad are generally symmetrical along at least one bisecting axis of each.

7. A holster according to claim 1, wherein said attaching means comprises complementary segments of loop tape and hook tape arranged to face one another when securely affixed to said supporting means and said bluing protection pad.

8. A holster for supporting a handgun adjacent a belt, said holster comprising:

a belt strap including a plurality of belt receiving slots near each end of said belt strap;

a bluing protection pad having an outer surface and a protective inner surface;

means for releasably attaching said bluing protection pad to said belt strap; and means for holding said bluing protection pad in a folded position and securing at least one end of said bluing protection pad to the belt in a manner creating a gun receiving pocket defined by said protective inner surface;

said belt strap being adjustable to vary the size of said gun receiving pocket by increasing or decreasing the distance between the said belt receiving slots through which the belt is threaded to change the area within which said gun receiving pocket can be positioned between said belt strap and the belt.

9. A holster according to claim 8, wherein said belt strap is generally symmetrical about an axis perpendicular to its length, and said bluing protection pad is generally symmetrical about its longitudinal axis, to permit the use of said holster by both right-handed and left-handed shooters.

10. A holster according to claim 8, wherein said protective inner surface is impregnated with a light film of oil.

11. A holster according to claim 10, wherein a wool mat forms said positive inner surface.

12. A holster according to claim 8, wherein said bluing protection pad includes a belt receiving slot near one end thereof.

13. A holster according to claim 8, wherein the belt is threaded only through the two belt receiving slots situated nearest each end of said belt strap, respectively, to maximize the area within which said gun receiving pocket can be positioned between said belt strap and the belt, and wherein the belt is threaded through one or more of said belt receiving slots other than the two belt receiving slots situated nearest each end of the belt strap, to reduce the area within which said gun receiving pocket can be positioned.

14. A holster for supporting a handgun adjacent a belt, said holster comprising:

a belt strap including a plurality of belt receiving slots near each end of said belt strap, said belt strap being generally symmetrical about an axis perpendicular to its length;

a bluing protection pad having an outer surface and a protective inner surface, said bluing protection pad being generally symmetrical about its longitudinal axis;

means for releasably attaching said bluing protection pad to said belt strap; and means for holding said bluing protection pad in a folded position and securing at least one end of said bluing protection pad to the belt in a manner creating a gun receiving pocket defined by said protective inner surface;

the configuration of said belt strap and said bluing protection pad permitting use of said holster by both right-handed and left-handed shooters.

15. A holster for supporting a handgun adjacent a belt, said holster comprising:

a belt strap including a plurality of belt receiving slots near each end of said belt strap;

a bluing protection pad having an outer surface and a protective inner surface, said protective inner surface being impregnated with a light film of oil;

means for releasably attaching said bluing protection pad to said belt strap; and means for holding said bluing protection pad in a folded position and securing at least one end of said bluing protection pad to the belt in a manner creating a gun receiving pocket defined by said protective inner surface.

16. A holster according to claim 15, wherein a wool mat forms said protective inner surface.

17. A holster for supporting a handgun adjacent a belt, said holster comprising:

a belt strap including a plurality of belt receiving slots near each end of said belt strap;

a bluing protection pad having an outer surface, a protective inner surface and a belt receiving slot near one end thereof;

means for releasably attaching said bluing protection pad to said belt strap; and means for holding said bluing protection pad in a folded position and securing at least one end of said bluing protection pad to the belt in a manner creating a gun receiving pocket defined by said protective inner surface.

* * * * *